United States Patent [19]

Famolare, Jr.

[11] 4,041,618

[45] Aug. 16, 1977

[54] CONTOURED SOLE FOR HIGH HEELED SHOES

[75] Inventor: Joseph P. Famolare, Jr., Florence, Italy

[73] Assignee: Famolare, Inc., New York, N.Y.

[21] Appl. No.: 728,603

[22] Filed: Oct. 1, 1976

Related U.S. Application Data

[63] Continuation of Ser. No. 710,097, July 30, 1976, abandoned, which is a continuation of Ser. No. 536,895, Dec. 27, 1974, abandoned.

[51] Int. Cl.[2] ..... A43B 13/00

[52] U.S. Cl. ..... 36/25 R; 36/29; 36/32 R

[58] Field of Search ..... 36/25, 28, 29, 32 R

[56] References Cited

U.S. PATENT DOCUMENTS

| | | | |
|---|---|---|---|
| 1,486,630 | 3/1924 | Burnett | 36/33 X |
| 2,124,986 | 7/1938 | Pipes | 26/32 R X |
| 2,307,402 | 1/1943 | Gregg | 36/32 R X |
| 3,087,261 | 4/1963 | Russell | 36/28 |
| 3,719,965 | 3/1973 | Chevallereau | 36/32 R X |

FOREIGN PATENT DOCUMENTS

| | | | |
|---|---|---|---|
| 1,017,009 | 9/1952 | France | 36/28 |
| 806,647 | 5/1952 | Germany | 36/29 |
| 89,667 | 7/1937 | Sweden | 36/28 |
| 138,794 | 2/1920 | United Kingdom | 36/29 |

*Primary Examiner*—Alfred R. Guest

*Attorney, Agent, or Firm*—Mandeville and Schweitzer

[57] ABSTRACT

A substantially flexible unitary wedge-shaped unit sole for high heeled shoes is disclosed contoured with compound curves in the side bottom surfaces thereof to enhance the comfort and stability of the wearer while at rest, and further to enhance the stride during walking. In addition, the sole is constructed to provide the stable feed of a solid wedge while being substantially hollow to reduce the weight thereof, and to provide a deliberately placed flexibility during walking.

3 Claims, 7 Drawing Figures

CONTOURED SOLE FOR HIGH HEELED SHOES

REFERENCE TO RELATED APPLICATIONS

This application is a continuation of applicantion Ser. No. 710,097, filed July 30, 1976, which application is a continuation of application Ser. No. 536,895, filed Dec. 27, 1974 both now abandoned.

STATEMENT OF THE INVENTION

In general terms, this invention relates to a specifically designed relatively solid wedge-shaped unit sole for shoes, to provide certain benefits for the wearer not otherwise available from conventional soles. More particularly, this invention relates to a wedge-shaped sole for high heeled shoes having juxtaposed compound curves in the bottom and side elevational surfaces thereof. This sole, with its compound-curved contour, provides simultaneously the substantial feel of a solid wedge while being relatively lightweight and flexible to accommodate and enhance the walking action or stride of the wearer. Moreover, the contours of the sole, in accordance herewith, serve to improve posture and leg muscle tone during standing because of the compound-curved nature of the construction herein.

BACKGROUND OF THE INVENTION

The prior art discloses many shoe soles contoured for a variety of purposes. For example, contoured "orthopedic soles" have been developed for enhancing the comfort and physical well-being of the wearer. In addition, wedge-shaped inclined soles have been developed for use in playing golf and other sports-related activities to facilitate the assumption of appropriate stances during those activities. Such developments, to varying degrees, add to the comfort or proper stance of the wearer, or force the wearer during stride to maintain the feet in a certain orientation when the sole is placed on a supporting surface.

SUMMARY OF THE INVENTION

With this invention, by contrast, a new and improved contoured unit sole for high heeled shoes is provided, which enhances in a positive manner the comfort of the wearer and the stability thereof not previously known in high heeled shoes. The generally wedge-shaped sole incorporates in the bottom surface and the side elevational surfaces thereof, a series of alternating crests and troughs, which give the sole a free-flowing, wave-like appearance. Moreover, by incorporating this alternating crest arrangement, both with respect to the sides and bottom surface thereof, the sole provided for the necessary flexibility in combination with stability not ordinarily available in high heeled shoes, together with an increased comfort for the wearer.

The walls forming the sides or circumference of the sole and the bottom surface thereof are solid. However, a substantial portion of the center of the sole is hollow, with the hollow space being filled with a crossweb structure forming a honeycomb appearing center portion for the sole. This honeycomb structure provides the necessary support for the foot while still making the sole considerably lighter than if the sole were a solid wedge.

Included with the webbed honeycomb structure are vertical, integral supporting post structures in the heel and toe area of the sole where the weight of the wearer is most likely to be momentarily concentrated in a walking action. Furthermore, the web incorporates a plurality of strategically spaced horizontal ribs integrally formed in the crossweb honeycomb. They are, for example, in the heel area and immediately in front of and behind the area of the highest degree of flexing action of the sole during walking, in order to deliberately center the flexure of the sole during this action, and to add to the generation of a forward momentum for the wearer during walking.

In conjunction with the curved contour of the sole, in accordance herewith, the upper or insole surface thereof is "orthopedically" contoured to properly support the foot in overall contact. Accordingly, the toe portion of the insole is raised with a lower, gradual curved area in the ball of the foot, and with a curved and raised platform area for the arch and heel of the foot. Moreover, the top surface of the solid outer wall of the sole is tapered inwardly, in order to provide a slightly cupped surface for the bottom of the foot of the wearer.

Before describing this invention further, it should be noted that the sole herein may be manufactured by molding from natural or synthetic elastomers, various resins, including thermoplastics, and a variety of foamed resin materials. Preferably, the material will be somewhat flexible to enhance the thrusting action of the sole. The sole may be combined with a conventional upper of a flexible material, including leathers, or synthetic materials, canvas and other fabrics, etc., to form a unique and improved high heeled shoe. Moreover, the upper may be of a scuff-like design with an open heel, or it may be straps, providing a sandal-like configuration.

With the foregoing and additional objects in view, this invention will now be described in more detail, and other objects and advantages hereof will be apparent from the following description, the accompanying drawings, and the appended claims.

As purely illustrative of an arrangement of the high heeled sole of this invention, the accompanying drawings illustrate a "wedge" high heeled sole without any upper construction or insole shown, in order to show the details of the construction of the sole more clearly.

DESCRIPTION OF THE PREFERRED EMBODIMENT

Figure 1:
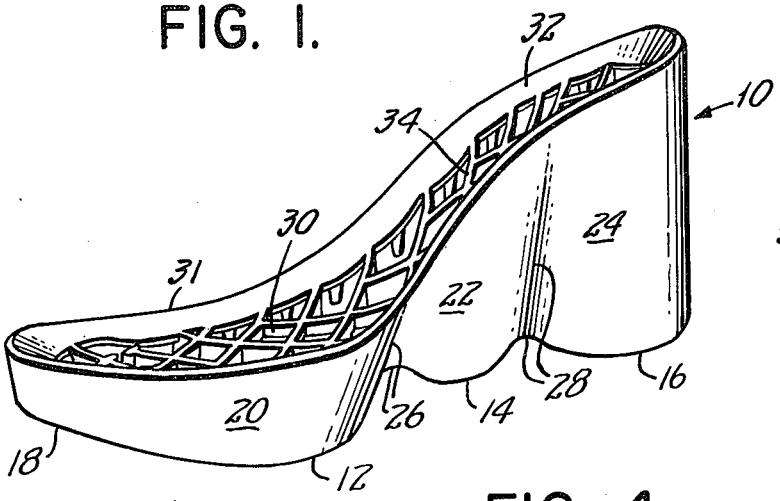
FIG. 1 is a perspective side elevational view of the sole of the invetion.

Referring to the drawings in which like reference characters refer to like parts throughout the several views thereof, FIG. 1 shows an integral sole generally designated 10 for high heeled shoes. As shown, the bottom surface of the sole has three curve-like portions 12, 14 and 16 alternating with troughs 26 and 28. The curve portions 12, 14 and 16 are generally in the areas of the ball of the foot, the arch of the foot, and the heel of the foot, respectively, and each of these portions have juxtaposed alternating curved side elevational portions 20, 22 and 24, respectively. Because of this curved configuration, both in the bottom surface of the sole 10 and in the side elevation thereof, the sole is provided with a compound-curved construction which serves not only to give it a graceful undulating appearance, but also provides appropriate deliberately positioned flexing characteristics which will be described in more detail below. As can be seen in FIG. 1, the bottom surface 18 of the toe portion of the sole 10 is slightly raised or elevated from the curved portion 12 in the area of the ball of the foot. This provides a walking action and gives the wearer a certain thrust forward during striding.

Figure 4:
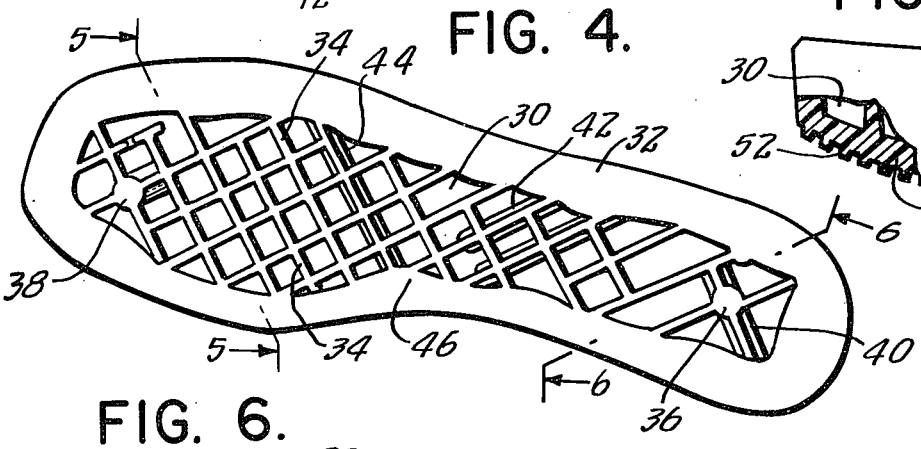
FIG. 4 is a top plan view of the sole of FIG. 1.

As can be seen in FIGS. 1 and 4, the sole has relatively thick, solid side walls 33 around the entire periphery thereof and bottom wall 35 to provide a degree of rigidity for the high heeled construction. Internally of these relatively thick walls is a hollow portion or space 30, which is filled with a series of criss-crossed webs or integral crossed walls 34, which provide a honeycomb construction filling the entire internal cavity 30. It will be appreciated with such construction that because a substantial portion of the internal area of sole 10 is hollow, it will be considerably lighter than would be the case if the entire sole were comprised of a solid material. Moreover, because the walls or webs 34 are integral with the solid circumferential walls 33 and bottom wall 35 of shoe 10, the entire sole can be formed as one piece in a single molding operation. The webs 34, because of their honeycomb-like arrangement sitll give sufficient support, coupled with a degree of flexibility for the sole during walking or striding action by the wearer. For additional strength and further reinforcement of the high heel portion, a separate vertical column of wood or plastic or other lightweight stiffening material may be molded in situ into the heel portion of and thereby integrated with the unit sole, when the sole is molded from resilient materials such as "Kraton".

Figure 6:
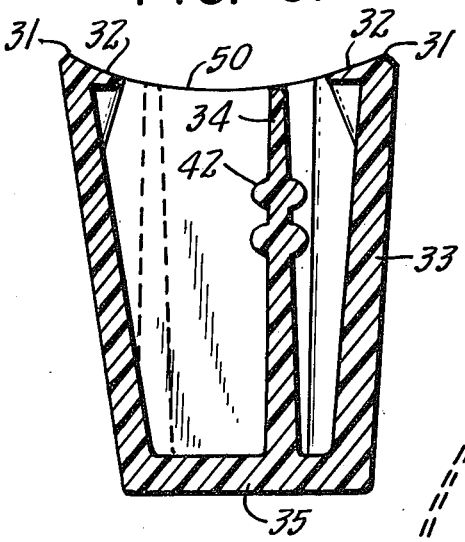
FIG. 6 is a cross sectional view taken along lines 6—6 of FIG. 4.

At the intersection of two such crosswebs 34 in the heel area and the toe area two integral vertical posts or pillars, which provide a certain degree of extra support in the areas where weight of the wearer will be momentarily concentrated during periods of striding action. Post 36 is shown in FIG. 4 in the heel area, and post 38 in the toe area. In addition, a series of strategically placed horizontal ribs, such as 42 (FIGS. 4 and 6) are disposed integral with and parallel with certain of the webs 34. The ribs 42 are placed in the arch region immediately to the rear of the area 46 of most flexure of the sole 10, as shown in FIG. 4 and 6. In addition, ribs 44 are shown placed immediately in front of area 46, with ribs 44 arranged perpendicular to ribs 42. Such an arrangement serves to deliberately concentrate the desired area of flexure 46 in the sole for the wearer. In addition, ribs 40 are shown in the heel area integral with post 36 to provide additional support in that area of higher elevation.

Figure 2:
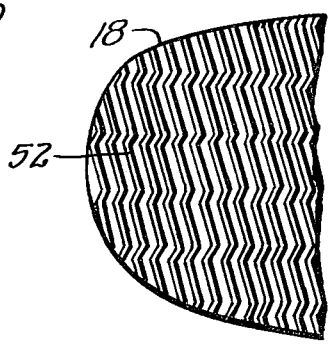
FIG. 2 is a bottom plan view of the toe portion of the sole of the invention.
Figure 3:
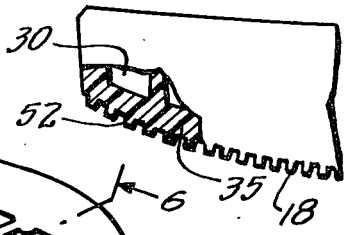
FIG. 3 is a side elevational view of the toe portion of the sole of FIG. 1, with a portion broken away to show the unitary nature of the sole of the invention.

As shown in FIGS. 2 and 3, the bottom surface of the sole has integral indentations 52 in a herringbone configuration to provide enhanced traction in the sole for the wearer. Indentations 52, as shown in FIG. 3, are integral with the solid bottom wall 35 of sole 10. As will be understood, the indentations may be of any configuration to provide a roughened surface, as long as they are of a configuration to be compatible with an integral mold manufacturing procedure.

Figure 5:
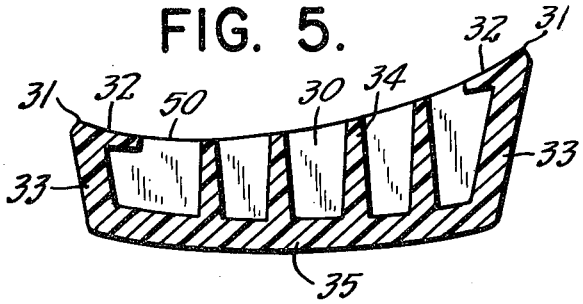
FIG. 5 is a cross sectional view taken along lines 5—5 of FIG. 4.
Figure 7:
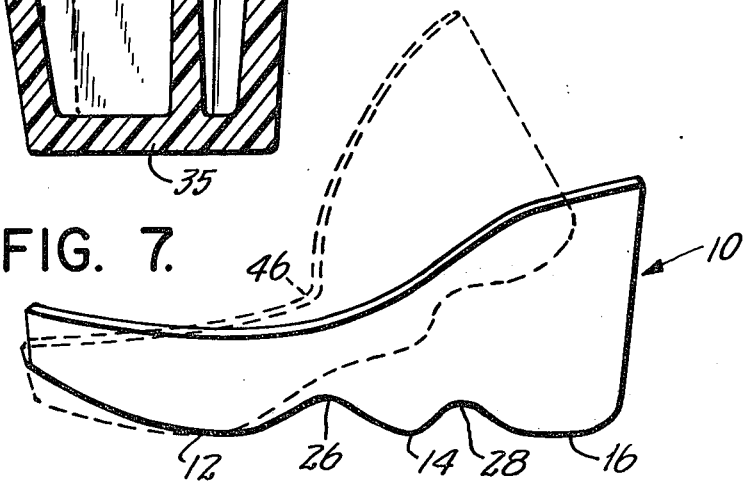
FIG. 7 is a side elevational view of the sole of FIG. 1 showing two positions of flexure thereof.

As can be seen in FIG. 5, the relatively solid side walls 33 have tapered top surfaces 32, inclined from the top edge 31 thereof toward the center of the sole. These tapered surfaces 32, together with a curved outline 50 defined by the top surfaces of web 34, give a somewhat confining or cup-like presentation to receive an insole and the bottom surface of the foot of the wearer.

As discussed above, because the bottom surface of sole 10 is divided into a series of curved crest portions 12, 14 and 16, and because the side contours of the sole are also divided into three curved areas 20, 22 and 24, this alternating pattern of crests serves to incorporate into sole 10 an inherent positive reflex action for the wearer during his striding movements.

Although, as discussed above, the sole may be comprised of a variety of materials, it is preferred, in accordance herewith, that the sole will be comprised of a flexible and resilient material, advantageously as a natural or synthetic elastomer, such as "Kraton" (styrene-butadiene block copolymer by Shell Oil Company) to impart flexibility and resiliency to sole 10 and to enhance its reflec action during the striding movements of the wearer. Moreover, because of the configuration of the various parts of the sole, in accordance herewith, every part may be molded simultaneously in a single molding operation, to provide the entire integral sole for a high heeled shoe. Because of the internal cavity and honeycomb configuration, the sole is relatively light, while still providing the proper stability for such high heeled soles. The strategic placement of the ribs and supporting posts enhances the stability, while automatically and deliberately directing the proper degree and area of flexure for the sole. Furthermore, because of the undulating appearance brought about by the series of curves in the bottom surface and side elevational walls of the shoe, it is aesthetically pleasing and graceful in appearance.

While the particular arrangement of sole described herein is one embodiment of this invention, this invention is not limited to that particular arrangement, and as will be appreciated and understood by those skilled in the art, changes may be made therein without departing from the scope of the invention, which is defined in the appended claims. For example, the specific geometry of the sole may be modified or somewhat altered in terms of proportions, numbers of crests and troughs, while maintaining the beneficial properties and appearance of the illustrated sole.

I claim:

1. A substantially flexible solid appearing sole for high heeled shoes comprising a. solid side, end and bottom walls defining an internal cavity;

b. a web disposed in said cavity comprised of a plurality of criss crossed, relatively thin walls defining a honeycomb construction, said web walls being integral with said side, end and bottom walls;

c. the outer surfaces of said side and bottom walls defining a plurality of juxtaposed alternating curves and troughs, said alternating curves of the side and bottom walls forming a compound-curved structure therein;

d. a plurality of pairs of integral horizontal ribs disposed in said cavity, one each of each pair of said ribs disposed on each side of one of said web walls between the top and bottom edges thereof.

2. A sole as described in claim 1, further characterized by a. two pairs of said ribs being disposed in spaced perpendicular relation to each other substantially midway of said sole and defining an area of flexure for said sole.

3. A sole as described in claim 1, further characterized by a. at least one vertical supporting post disposed in the heel and the toe areas of said sole; and b. said supporting posts being integral with said cross-web walls.

* * * * *